US005497645A

United States Patent [19]

Niedecker

[11] Patent Number: 5,497,645

[45] Date of Patent: Mar. 12, 1996

[54] U-SHAPED CLOSING STAPLE FOR BAGS AND FLEXIBLE TUBES AND APPARATUS FOR CLOSING THEM

[76] Inventor: Herbert Niedecker, Am Ellerhang 6, 6240 Königstein 2, Germany

[21] Appl. No.: 88,286

[22] Filed: Jul. 6, 1993

Related U.S. Application Data

[62] Division of Ser. No. 720,485, Jun. 21, 1991, Pat. No. 5,247,723.

[30] Foreign Application Priority Data

Dec. 28, 1988 [DE] Germany ..... 38 44 052.0
Dec. 6, 1989 [DE] Germany ..... 39 40 262.2

[51] Int. Cl.[6] ..... B21D 28/00

[52] U.S. Cl. ..... 72/330; 72/412; 29/243.56; 29/566.1; 53/138.4

[58] Field of Search ..... 72/410, 409, 412, 72/326, 330; 29/243.56, 243.517, 566.1; 53/138.4; 140/93 D

[56] References Cited

U.S. PATENT DOCUMENTS

| | | | |
|---|---|---|---|
| 2,709,255 | 5/1955 | Frank | 72/412 |
| 3,913,628 | 10/1975 | Keating | 53/138.4 |
| 3,940,841 | 3/1976 | Velarde | 29/243.56 |
| 4,807,345 | 2/1989 | Jacobson | 29/243.56 |

FOREIGN PATENT DOCUMENTS

| | | | |
|---|---|---|---|
| 26556 | 3/1884 | Germany | 29/243.56 |
| 585345 | 11/1958 | Italy | 29/243.517 |
| 324488 | 1/1930 | United Kingdom | 29/243.56 |
| 1053611 | 1/1967 | United Kingdom | 29/243.56 |

*Primary Examiner*—Daniel C. Crane
*Attorney, Agent, or Firm*—Sprung Horn Kramer & Woods

[57] ABSTRACT

In U-shaped closing staples for bags and flexible tubes, which staples are made of strip material and consist of a crosspiece (7) and two legs (4) and in which the leg ends of the staple have been bent off outwardly to constitute a connecting web (2), by which the staple is severably included in a train (1), the severing of each staple from the train (1) will result at the severing location in the formation of burrs, which protrude beyond the strip width of the staple and may result in damage to the closed wrapper and to other wrappers. An apparatus for closing bags and flexible tubes by means of such closing staples comprises a closing punch (9), which acts on a die (8) and is formed in its active surface (29) with a groove (10), which has the same width as the closing staple and has a depth which is smaller than the total thickness in which the legs are subjected to the closing operation. During the closing operation the side wall faces of the groove (10) guide the leg ends (6) and ensure that the staple leg ends (6) firmly engaging the staple legs (4) on the outside will be embossed without a formation of a burr.

1 Claim, 2 Drawing Sheets

Figure 1:
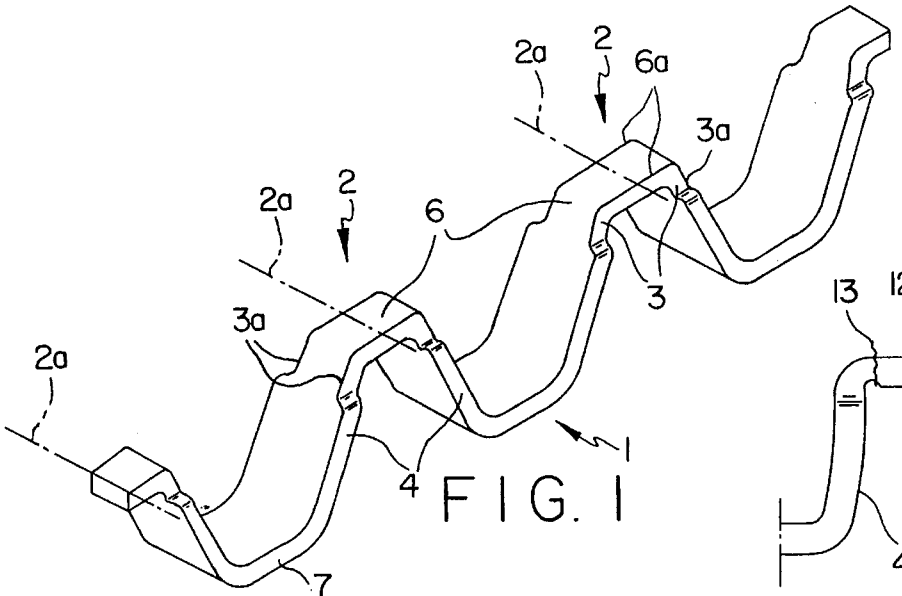

U-SHAPED CLOSING STAPLE FOR BAGS AND FLEXIBLE TUBES AND APPARATUS FOR CLOSING THEM

This is a divisional application of Ser. No. 720,485, filed Jun. 21, 1991, now Pat. No. 5,247,723.

This invention relates to a U-shaped closing staple made of strip material and intended for use with bags and flexible tubes, and to a closing apparatus comprising a closing punch and a die. The closing staple consists of a crosspiece and two legs, which have outwardly bent ends and together with the leg ends of adjacent staples constitute a severable connecting web. To close a wrapper a portion of the bag or flexible tube consisting, e.g., of a filled sausage casing is gathered to form a condensed portion, which is inserted into the staple, which is held in a die That conforms to the crosspiece of the staple. Thereafter he legs of the staple are cut from the train of staples by means of a closing punch, which is moved against the die, and the condensed portion is thus closed by the staple in an operation in which the leg ends are forced against the legs on the outside.

As each staple is severed from the striplike rain, burrs are formed at the parting line adjacent to The connecting web and if the strip width of the entire staple inclusive of the connecting web is approximately constant, as was the case in previously employed closing staples (German Patent Specification 10 78 495, Published German Application 26 06 658 and Published German Application 31 48 757), said burrs may laterally protrude beyond the strip width of the staple when he leg ends have been closed and forced against the legs on the outside so that the closed wrapper, such as the casing of a sausage, may be damaged. There is also a risk that other wrappers may be damaged during the further processing, e.g., by cooking. Finally, when the closed sausage is sealed into an evacuated second package the latter may be damaged by the burr and in such cases the user has often been induced to cut off the closing staple of the closed sausage before it was packaged in the second package. That additional operation is time-consuming and expensive.

For this reason the strip train of closing staples known from Published German Application 17 61 616 comprises connecting webs having on both sides an arcuate constriction, which is approximately symmetrical to the ideal parting line so that the width of the strip is reduced on both sides. It was intended thus to avoid a lateral protruding of burrs at the cut edges on the outwardly bent off leg ends after the closing operation. This has substantially been accomplished so that it was no longer necessary in many cases to cut the closing staple from the sausage, e.g., before a second packaging operation.

But it has been found that the bent off leg ends which constitute a part of the connecting web are not always forced by the closing punch against the legs on the outside thereof in a position in which said leg ends are centered with respect to the width of the strip. On the contrary, the closing operation may result in a slight canting so that the leg ends are somewhat laterally deflected and in that case again protrude laterally from the adjoining leg. This means that a protruding of burrs beyond the width of the strip has not been avoided with the reliability which is required.

It is sn object of the invention to provide for bags and flexible tubes a staple closure which will ensure a reliable closing operation and has no burrs protruding beyond the width of the strip, and also to provide an apparatus which can be used to make such closure.

According to a first aspect of the invention that object is accomplished in that in a closing staple which constitutes a part of a striplike train of closing staples the strip width is decreased not only in the leg ends but also in a leg portion which adjoins the end and the outer edges of the ends and portions of the leg are approximately parallel in the region in which the strip width is reduced. Owing to their parallel edges the narrower legs can be guided during the closing operation in the severing and closing punch - e.g., by the side edges of the groove or such recess. This will not restrain the closing movement of the legs but their laterally outward deflection (off the center) will reliably be avoided. Laterally beside the bent off leg ends the severing and closing punch will also act directly on the legs and will close the staple.

Besides - contrary to the closing staple known from Published German Application 17 61 616 - the strip width is reduced also at the bends of the leg ends so that a lower resistance will oppose the forcing of the leg ends during the closing operation. This result will be particularly significant with thick strip material and will also be significant because the leg ends to be bent off are short and regarding the reliable guidance of the leg ends in the punch. As a result, the bent off leg ends are forced more tightly against the legs so that the risk of subsequent damage inflicted by the closing staple will be decreased. An effect in the same direction is produced by the fact that a higher pressure per unit of area is applied to The narrower strip portion during the closing operation so that the outwardly disposed burr will be almost entirely forced away.

Whereas it is known from British Patent Specification 920,335 to positively guide a closing staple in the severing and closing tools during the closing operation by means of a rib, which extends almost entirely around the strip of each staple and is received by corresponding grooves in the closing punch and the die, that design has the disadvantage that the rib stiffens the staple so that a higher closing pressure will be required and that no pressure is applied to the staple during the closing operation adjacent to the rib, which is not supported where it protrudes into the groove, so that irregular bending and extruding processes will take place in the staple during the closing operation. This did not furnish. A suggestion that, as is taught by the invention, only the ends of a staple which has been severed from a Train should be guided to produce the desirable results set forth hereinbefore. Such a suggestion also has not been furnished by Published German Application 37 15 626 because it proposes a change of the thickness rather than of the width of the strip in order to achieve a different object.

The reduction of the width of the strip amounts to between 5 and 40%, preferably between 10 and 30%.

According to a preferred feature of the invention a trough-shaped or channel-shaped embossed recess is provided in the bottom surface of the strip material at the transition to each staple leg, as is known per se from Published German Application 17 61 616. In the closing staple in accordance with the invention that channel-shaped embossed recess affords in addition the advantages described in said prior publication.

A further preferred embodiment of the invention resides in that in a closing staple which is in accordance with the invention and has said channel-shaped embossed recesses a concave portion is provided between the U-shaped embossed recesses in the bottom or top surface of the connecting web and the thickness of the strip is even smaller in the middle of that concave portion than adjacent to the channel-shaped embossed recesses. Whereas the closing staple disclosed in Published German Application 17 61 616 has already a concave portion in the top surface of the connecting web, that concave portion is longer than the distance between the adjacent boundaries of the channel-shaped embossed recesses so that the strip has a smaller thickness between the channel-shaped embossed recess and the end of the concave portion than adjacent to the middle of the concave portion, i.e., at the location at which the strip is to be severed. This involves the risk that when the train of staples is wound up and unwound to a coil an arbitrary buckling may occur between the individual closing staples at the location where the strip has the smallest thickness, i.e., at the channel-shaped embossed recess. But the train of staples being wound up should desirably be bent in the middle of the connecting web so that the train of staples which is unwound will have no bend in the channel-shaped embossed recesses. Such bends in the channel-shaped embossed recesses will involve the risk that the staple which has been fed and inserted into the die may be canted so that a satisfactory closure cannot be made.

If, in accordance with the invention, the concave portion is provided in the bottom or top surface between the channel-shaped embossed recesses, a bending will be induced at a desired location in the middle of the connecting web and a formation of bends at the channel-shaped embossed recesses as the train of staples is wound up or unwound will be avoided.

Because the thickness of the strip is smaller in the middle of the concave portion than adjacent to the channel-shaped embossed recess, it will also be achieved that, because the width of the strip is reduced in accordance with the invention, the strip material will have the smallest cross-section at the location where the strip is to be severed. As a result, an often flaky abrasion will be avoided during the severing operation whereas such abrasion will sometimes occur in an undesired manner if the overall cross-section is thicker, particularly in packages for foodstuffs.

A further aspect of the invention resides in that a groove is formed (only) in the closing punch of the closing apparatus and the groove has a width which corresponds to the width of the closing staple and the groove has a depth which is smaller than the total leg thickness which is subjected to the closing operation. In that case the side faces of the groove will contact the outer side edges of the bent-off leg ends and of the staple legs and will prevent them from yielding laterally because the depth of the groove is only a part of the total leg thickness which is subjected to the closing operation so that the closing punch cannot be supported elsewhere and the closing pressure is uniformly applied throughout the width of the staple. In this respect there is no difference from the closing operation performed with conventional closing tools.

If the staples have a reduced width adjacent to the leg ends and the adjoining leg portions, as described hereinbefore, a further feature of the invention may be adopted which resides in that the width of the groove corresponds to the reduced width of the leg ends of the staple. In that case the closing punch in accordance with the invention may act directly on the remaining legs and may apply a closing pressure thereto also laterally of the leg ends, which are usually bent off outwardly. In that case the depth of the groove must be smaller than the thickness of the outwardly bent off leg ends so that they will fully be forced against the legs.

The arrangement is preferably such that the depth of the groove decreases from the middle to the ends in the longitudinal direction of the groove (in the peripheral direction of the staple). This will also ensure that the closing force will be distributed most uniformly to the staple during the closing operation whereas the guiding function of the groove adjacent to the leg ends will not adversely be affected.

It will also be desirable to form the cross-section of the groove with rounded corners so that sharp edges on the most widely protruding portions of the closed staple will be avoided and the staple can be more easily removed from the closing apparatus after the closing operation.

Figure 2B:
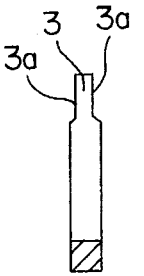
Figure 2A:
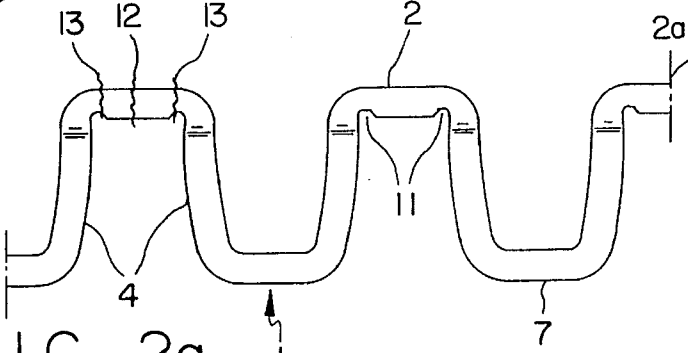
Figure 3A:
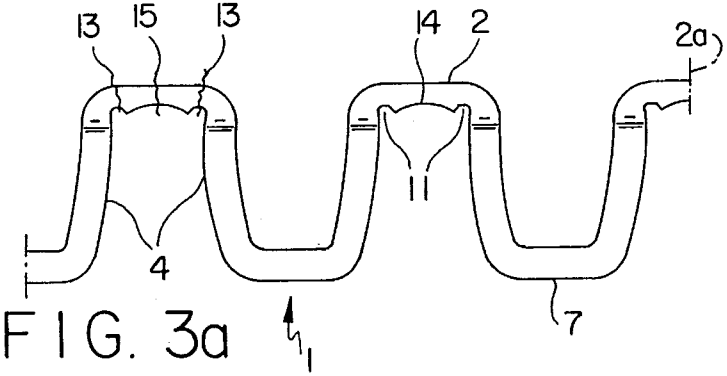
Figure 4:
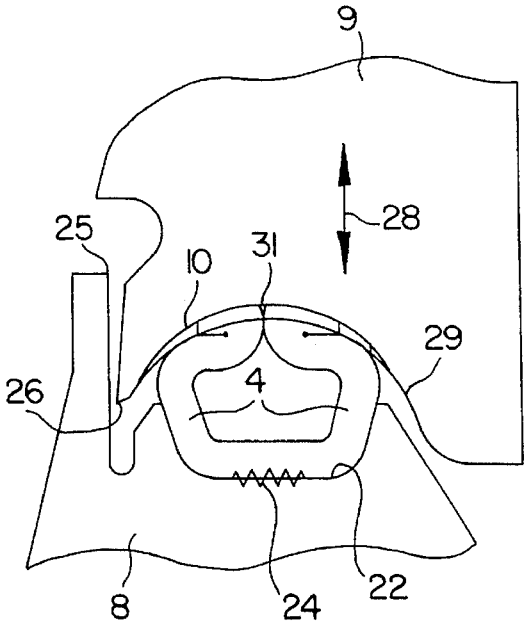
Figure 5:
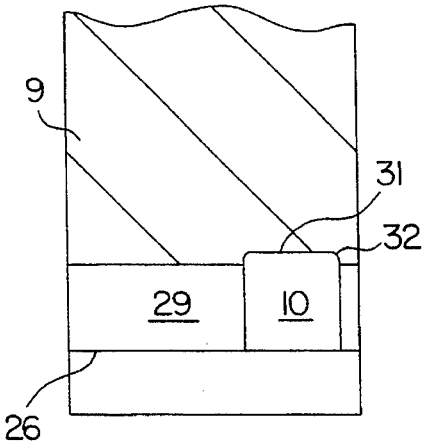
Figure 6:
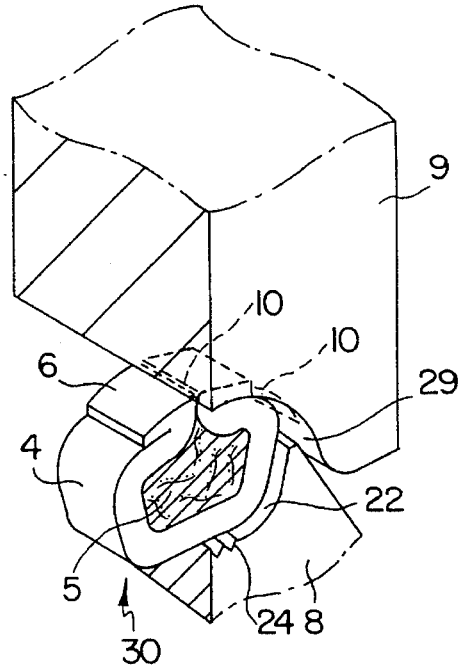
Figure 7:
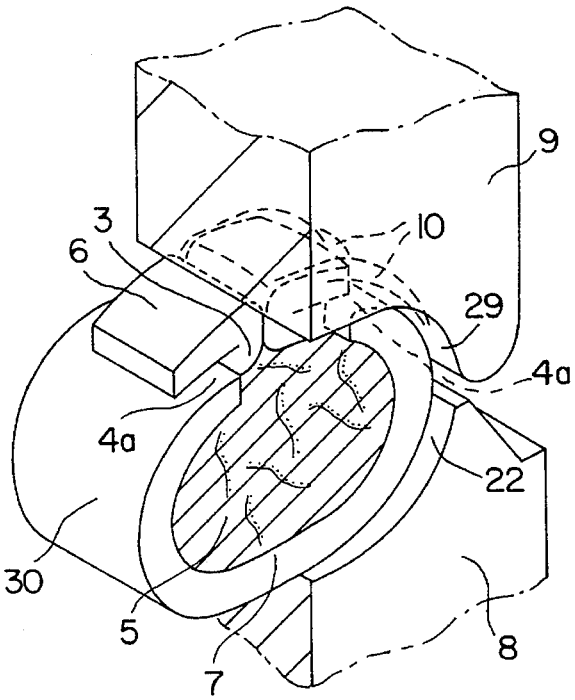

The invention will now be specifically explained with reference to the drawing, in which FIG. 1 is a perspective view showing a train of closing staples, FIG. 2*a* is a side elevation showing a modified train of closing staples, FIG. 2*b* is a transverse sectional view showing the same train of closing staples as FIG. 2*a*, FIGS. 3*a* and *b* are side elevations which are similar to FIG. 2*a* and show further modifications of the train of closing staples, FIG. 4 is a side elevation showing a closing apparatus in accordance with the invention, FIG. 5 is a central transverse sectional view showing an associated closing punch, FIG. 6 is a perspective view and a sectional view on the section plane in FIG. 5 and shows the closing apparatus of FIG. 4, and FIG. 7 is a view that is similar to FIG. 6 and shows a closing apparatus for closing the closing staples in accordance with the first aspect of the invention.

In the train 1 of closing staples shown in FIG. 1 the ends 6 (see FIG. 2) of the legs 4 constitute connecting webs 2 and said ends and a small portion 3 of the legs 4 have a reduced strip width parallel to the longitudinal axis of the train of closing staples. The side faces 6*a* of the leg ends 6 and the side faces 3*a* of the portions 3 of the legs 4 are parallel to each other. The location at which the connecting web 2 is (to be) severed is indicated by the phantom line 2*a*. The crosspiece of the staple is designated 7.

Figure 3B:
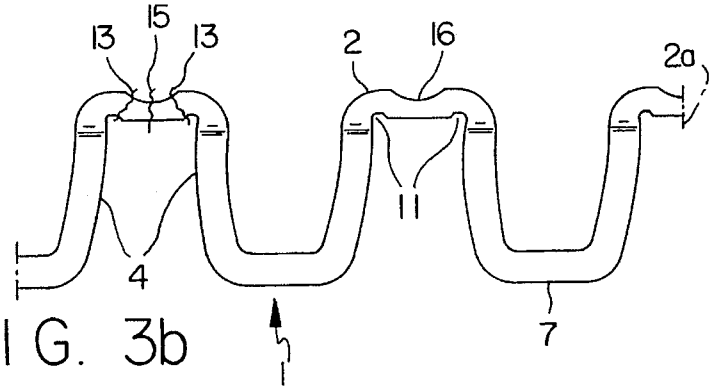

In accordance with FIGS. 2*a*, 3*a* and 3*b* the train of closing staples shown in FIG. 1 is formed with channel-shaped embossed recesses 11 at the transition from the staple legs 4 to the connecting web 2. FIG. 2*b* is a sectional view showing the train 1 of closing staples of FIGS. 2*a*, 3*a* and 3*b* with the side faces 3*a* of the portion 3 in which the strip has a reduced thickness.

As is apparent from FIG. 2*a* the solid cross-section 12 in the middle of the connecting web 2 is larger than the solid cross-section 13 adjacent to the channel-shaped embossed recesses. But the train 1 of staples may buckle at one of the channel-shaped embossed recesses 11 as the train 1 is wound up and unwound.

For this reason FIG. 3*a* shows that the train 1 of staples shown in FIG. 2*a* has a concave portion 14 in the bottom surface of the connecting web 2 between the channel-shaped embossed recesses 11 and FIG. 3*b* shows that said train has a concave portion 16 in the top surface of the connecting web 2 between the channel-shaped embossed recesses 11. As the train of closing staples is wound up and unwound, it will bend only at the location 2*a* at which the strip is to be severed in the middle of the connecting web 2.

The closing apparatus in accordance with the invention will now be described. Only the upper part of the die 8, i.e., that part which is of interest here, is shown in FIG. 4. The die 8 has a trough-shaped recess 22, which at the beginning of a closing operation receives and partly embraces a closing staple 30, which has already been closed in FIG. 4. The recess 22 provides the required abutment during the closing operation. During the closing operation, flutes 24 provided on the bottom of the recess 22 will hold the closing staple 30 in the desired position when the cutting of the staples from a train of interconnected staples (FIG. 1) begins; for this purpose the knife edges 25 and 26 (on the closing punch) cooperate.

The closing punch 9 is movable in the direction of the arrow 28 (which may consist of a pivotal movement with a large radius). In FIGS. 4, 6 and 7 the closing punch 9 is shown in its bottom end position at the end of a closing operation.

As is apparent from FIG. 4 the active surface 29 of the closing punch 9 is concave and is formed with a groove 10, which has the largest depth in the middle (at 31) and the depth of which decreases toward the ends and in the example decreases to zero. The largest-depth of the groove is smaller than the thickess of the legs 4 of the staple 30 and mounts only to the (smaller) thickness of the leg ends 6 at their termination.

The cross-section of the groove 10 is apparent from FIG. 5, which shows only the closing punch 9. The groove 10 has rounded corners 32. If sausages are to be closed in an operation in which the trailing end of one sausage and the leading end of the next following sausage are closed at the same time, two closing apparatuses of the illustrated type will be provided in practice and will be consecutively arranged, i.e., juxtaposed in the paper plane. As a result, a further closing punch, which is a mirror image of the closing punch 9 shown in FIG. 5, (and the corresponding die) will be provided on the left of the closing punch 9 shown in FIG. 5. There is a certain space between said two punches and a severing knife can be moved through said space. The closing apparatuses are shown on a larger scale in the drawing: For instance, the closing punch 9 shown in FIG. 5 has a width of 13 mm and the groove 10 has a width of 5 mm.

When a closing staple 30 has been severed from the train of staples but has not yet been closed the closing staple 30 has an open-topped U-shape with divergent legs 4, which are succeeded by leg ends 6, which have been angled into the horizontal. During the closing operation the leg ends 6 are received and laterally guided by the groove 10. As the stroke of the closing punch 9 is continued, the legs 4 are bent around the condensed packaging material 5 and the leg ends 6 tightly engage the outside surface of the legs 4 so that the shape shown in FIGS. 4 and 6 is finally assumed. In FIG. 6 the condensed portion 5 of a sausage casing or the like is shown in section to extend within the closed staple 30.

The closing clip 30 shown in FIG. 7 is the one which has been described hereinbefore and in which the width of the leg ends 6 and of an adjoining portion 3 of the legs 4 have a reduced width. The width of the groove 10 is correspondingly reduced. Those portions of the active surface 29 of the closing punch 9 which are disposed on opposite sides of the groove 10 will reliably act directly on the shoulders **4*a* of the closing staple 30 at the end of the closing operation. Said shoulders 4*a* are formed by the full-width portions adjacent to the leg portions 3 which have a reduced width. The drawing indicates that the leg ends 6 (having a reduced width) which are constituted by portions of the former connecting web 2 have centrally been forced against the outside surface of the legs 4**.

I claim:

1. Means for closing a bag or flexible tube by a staple comprising in combination (A) a strip of potentially closing staples and (B) an apparatus for severing a staple from said strip and closing it about a bag or flexible tube, (A) the staples of the strip consisting of a cross piece and two legs (4) having ends (16) which are outwardly bent and together with leg ends (16) of adjacent staples constitute a severable connecting web (2) having a top surface and having a strip width which is reduced on both sides, wherein the strip width is reduced at the bends of the ends (16) of the legs (4) of the staple as well as in a portion (3) of each leg (4), which portion (3) adjoins the end (16), and side faces of the ends (16) and the portions (3) of the legs (4) are approximately parallel in the region in which the strip width is reduced, and (B) the severing and closing apparatus comprising a closing punch, and a die against which the closing punch is movable so that the legs of a staple supported on the die are bent toward each other and forced toward the crosspiece of the staple by the closing punch, the closing punch having in its active surface only a single groove which extends in the peripheral direction of the staple and positively cooperates with the closing staple during the closing operation, the groove (10) in the closing punch (9) having a width corresponding to the reduced width of the staple (30) and having a depth which is smaller than the total thickness.

* * * * *